United States Patent [19]

Klees et al.

[11] Patent Number: 4,887,422

[45] Date of Patent: Dec. 19, 1989

[54] ROPE WITH FIBER CORE AND METHOD OF FORMING SAME

[75] Inventors: David A. Klees; Robert B. Hoganson; Harry L. Data, all of Kenosha, Wis.

[73] Assignee: AMSTED Industries Incorporated, Chicago, Ill.

[21] Appl. No.: 241,052

[22] Filed: Sep. 6, 1988

[51] Int. Cl.[4] ..... D07B 1/06

[52] U.S. Cl. ..... 57/220; 57/216; 57/218; 57/3; 57/6; 57/7

[58] Field of Search ..... 57/200, 210, 212, 214, 57/216, 217, 218, 220, 221, 222, 223, 229, 232, 213, 3, 6, 7

[56] References Cited

U.S. PATENT DOCUMENTS

| | | | |
|---|---|---|---|
| 3,197,953 | 8/1965 | Dawbarn et al. | 57/216 |
| 4,034,547 | 7/1977 | Loos | 57/222 X |
| 4,123,894 | 11/1978 | Hughes et al. | 57/220 |
| 4,176,705 | 12/1979 | Russell et al. | 57/220 X |
| 4,219,995 | 9/1980 | Tajima et al. | 57/220 |

FOREIGN PATENT DOCUMENTS

| | | | |
|---|---|---|---|
| 122842 | 10/1978 | Japan | 57/220 |

*Primary Examiner*—Donald Watkins

*Attorney, Agent, or Firm*—Edward J. Brosius; Charles E. Bouton

[57] ABSTRACT

This invention provides a composite wire rope comprising a plurality of outer strands laid helically about a helically stranded core. The core is comprised of high strength synthetics, such as polyamide or polyolefin materials to form a unitized lay central member. The method for forming the rope comprises the steps of twisting high strength synthetic monofilament yarns into core elements to provide a high degree of stability and overall tensile strength. Each such element is helically laid in a single operation to form the finished core. Lubricant may be applied and subsequently a protective jacket of steel, natural or synthetic material may be provided to encapsulate the core and lubricant. The rope structure is completed by helically laying a plurality of outer strands about the core.

20 Claims, 5 Drawing Sheets

ROPE WITH FIBER CORE AND METHOD OF FORMING SAME

BACKGROUND OF THE INVENTION

This invention relates in general to an improved wire rope and, more particularly, to a rope having a central fiber core comprised of aramid or other high strength synthetic elements.

Within the wire rope industry, there is a class of roping materials that are known by the term "elevator system ropes". These materials are used in a drive system as (1) hoisting ropes providing suspension of freight and passenger elevator cars and the vertical displacement of same by means of traction drive, (2) counterweight ropes used for suspension and vertical displacement of system counterweights and (3) compensator ropes which can be used in conjunction with 1 or 2 above.

In the U.S. elevator industry, standard elevator rope sizes range from ⅜" to over ¾" (9.5 to 19.0 mm). Most of such ropes have a central core member comprised either of a monofilament polypropylene or natural fiber such as manila, sisal, or jute. Typically, such ropes have outer strands of various grades of steel in a 6 or 8 strand arrangement.

In addition, elevator hoisting ropes comprising an independent wire rope core are currently in use in Europe for large structures, albeit with a unit rope weight penalty approaching 30%.

The decreasing availability of natural fibers such as manila, jute, mauritius or sisal has led to a shift to synthetic fibers in attempts to provide an adequate core material. Widely used synthetic monofilaments such as the polyolefins or nylon, are not yet accepted as a core material by the elevator market due to possible hygroscopic character, low effective modulus and relatively low compression resistance. These factors result in higher stretch values and increased likelihood for strand to strand contact and earlier onset of fatigue.

The development of high strength synthetic materials, such as the polyamide and polyolefin families, having relatively high coefficients of elasticity along with lower weight compared to steel has resulted in attempts to hybridize or develop rope sections to take advantage of the benefits these fibers offer. The superior environmental exposure resistance, along with the precision available in the manufacture of monofilament yarns of specific denier, provides the rope manufacturer with the ability to hold closer tolerances with these synthetics versus natural fiber materials.

Past inventions have attempted to incorporate these materials in a multitude of applications, some of which are hybrid forms, using steel outer strands over a synthetic core as presented in U.S. Pat. Nos. 4,034,547, 4,050,230 and 4,176,705, and South African Pat. No. 86-2009. In these patents the cores of the ropes are said to be of parallel or minimal lay designs, with the cores made up of monofilament yarns, in attempts to maximize elastic modulus and associated tensile strength. The major drawback of this approach is that ropes of this type, when loaded, shift the majority of the load onto the central core, which yields in tensile before maximum load can be imparted to the surrounding steel strands.

The conservative design factor and sheave criteria imposed in elevator standards shifts the rope performance requirement from that of strictly strength over a minimal life to that of fatigue resistance, with expected lifetimes reaching 5 years or more. The rope is expected to maintain diameter to provide proper bedding in traction sheaves, with the outer steel strands being expected to provide a tractive interface between rope and sheave as well as enduring tensile loadings and bending stresses as the rope passes through the system. The fiber core must meet a separate set of parameters, maintaining its integrity and uniformity of diameter and density, while resisting decomposition or disintegration, in order to support the rope strands for the full lifecycle of the rope.

SUMMARY OF THE INVENTION

Therefore it is an object of the present invention to provide a rope that has improved overall strength properties. It is another object of the present invention to provide an elevator operating rope yielding a significant enhancement in fatigue endurance properties.

Generally, the present invention provides a rope consisting of a plurality of outer strands laid helically about a high strength synthetic fiber core. The core is designed to have a modulus about equal to that of the outer strands.

The core is comprised of a multitude of component members designed to provide a maximized cross-section with minimal free space (highest possible fill factor). All core component members are formed in unit-laid fashion by being closed helically in a single operation. The helix is imparted to effect the stabilization of the core, yield effective compression resistance, maximize intermember contact area and, most importantly, to develop an optimal rope efficiency between the core and the outer strands by way of a matched effective rope modulus. The core may be secondarily processed by application of a sheath of a minimum thickness, either by application of a braided or helically wound covering of steel, synthetic or natural elements or coated with a thermoplastic, elastomer or other continuous coating material. The sheathing is applied to minimize abrasion of the underlying synthetic core by the outer strands which most frequently are steel and to prevent intrusion of debris or deleterious cleaning solvents or lubricants. Each member of the core is developed by spinning of a number of available denier filaments by way of a twist multiplier providing dimensional stability and maximized element strength.

DETAILED DESCRIPTION OF THE INVENTION

Figure 1:
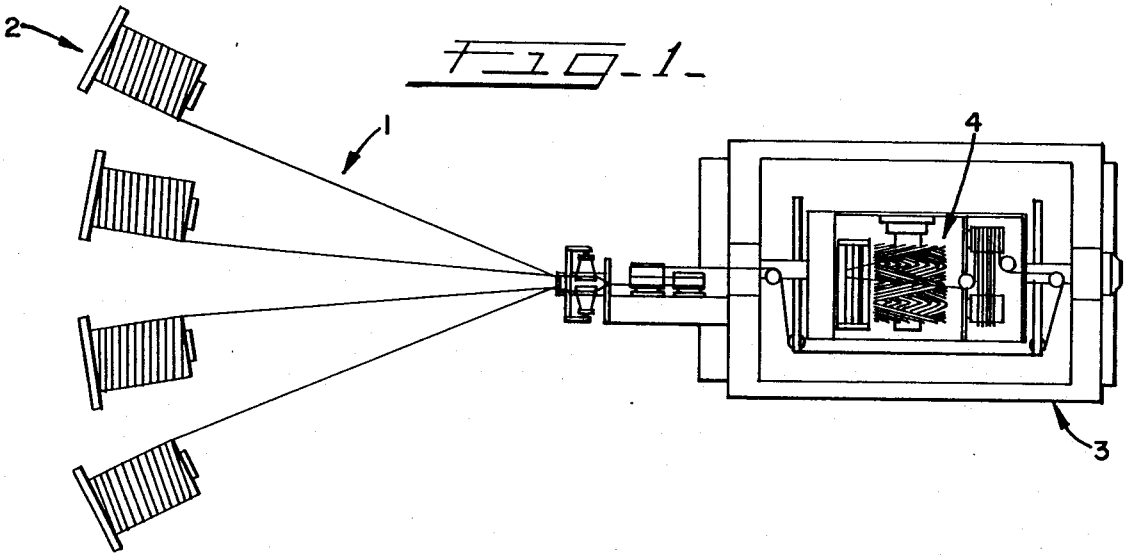
FIG. 1 is a schematic view of the twisting operation in forming individual core strand elements from combinations of synthetic fibers.

Referring first to FIGS. 1–4, a wire rope is formed according to the present invention by assembling a multitude of 1500 denier yarns, produced from synthetic fibers 1 of Kevlar (a trademark of E. I. DuPont de Nemours & Co.) aramid Type 960 material. This aramid material has high tensile strength and low elongation character and is drawn from creels 2 and downtwisted in an operation 3 in a left lay direction to form elements 4. The elements 4 so formed by the steps shown in FIG. 1 are then themselves stranded in the operation shown in FIG. 2. Each of the elements 4, packaged on spoolless cores, is passed through conventional stranding equipment 5, specially modified with proper tensioning and ceramic guide surfaces, and is helically laid in a single operation in a left lay direction into a finished lang lay core 6. Lang lay means having the same lay direction for both the elements and the finished core. Dependent upon the geometry of the core each gallery of distinct elements has its own applied helix angle dictated by core lay length. One preferred core construction is 1×25F wherein one center element 4A is covered by six inner elements 4B, then gap-filled by six small elements 4C, with this subgroup covered by twelve outer elements 4D all in one operation.

Figure 2:
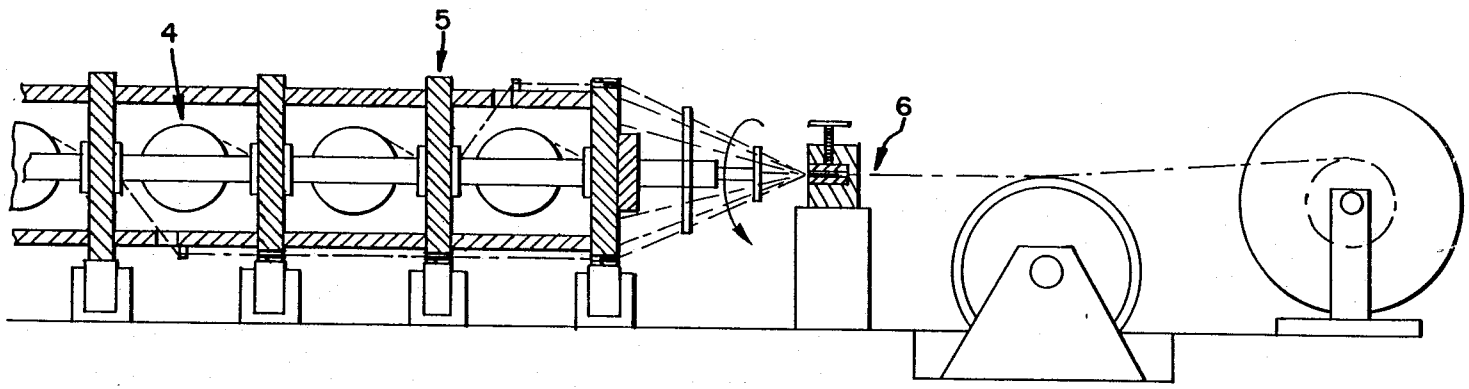
FIG. 2 is a schematic side view of a closing operation in which the core strands are formed into the finished core.
Figure 3:
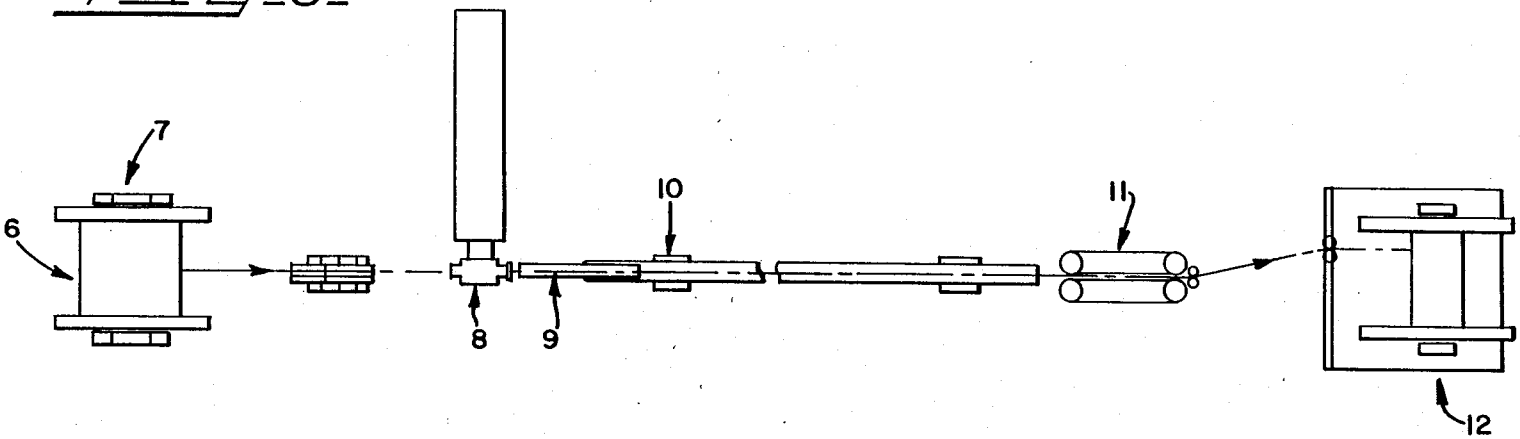
FIG. 3 is a schematic view of the preferred embodiment of extrusion coating said core with a protective covering.

The multi-element core thus produced by the steps in FIG. 2 is then coated in a process shown in FIG. 3 and then processed to form a finished rope. The core 6 is paid off from a back-tensioned reel stand and into the crosshead of an extrusion system 8 where a coating 9 is applied to said core. Coating 9 is die-sized to exacting tolerances as dictated by the finished rope design. Subsequently, the coated core is immediately passed through a water contact cooling system 10 to solidify the molten thermoplastic cover. A cattrack-type traction device 11 provides the pulling force required to pull the core through the extruder and onto a takeup reel 12.

Figure 4:
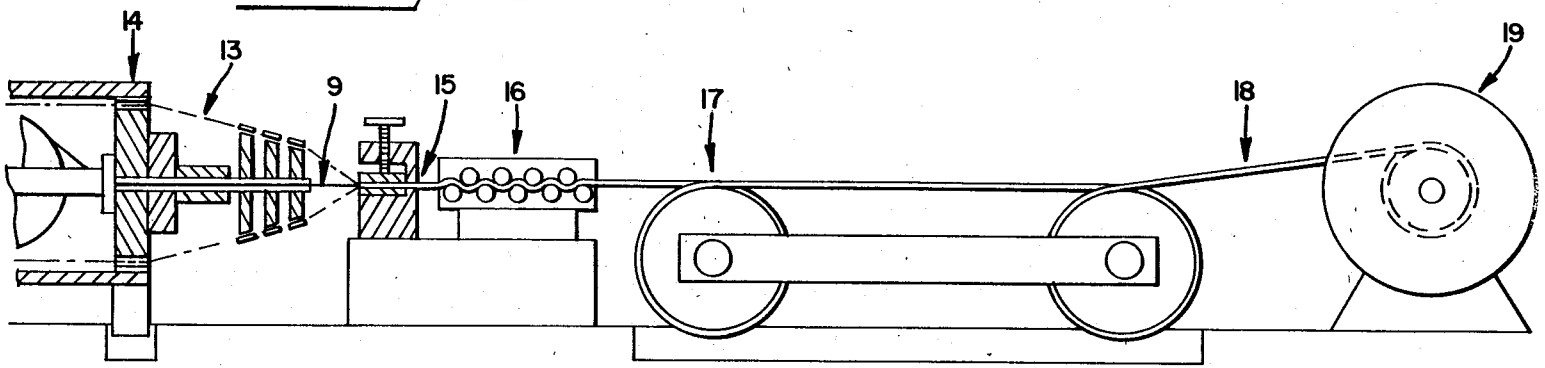
FIG. 4 is a schematic view of the rope closing operation in which the forming of the rope is facilitated by helically laying the steel outer strands about the core according to the present invention.
Figure 5:
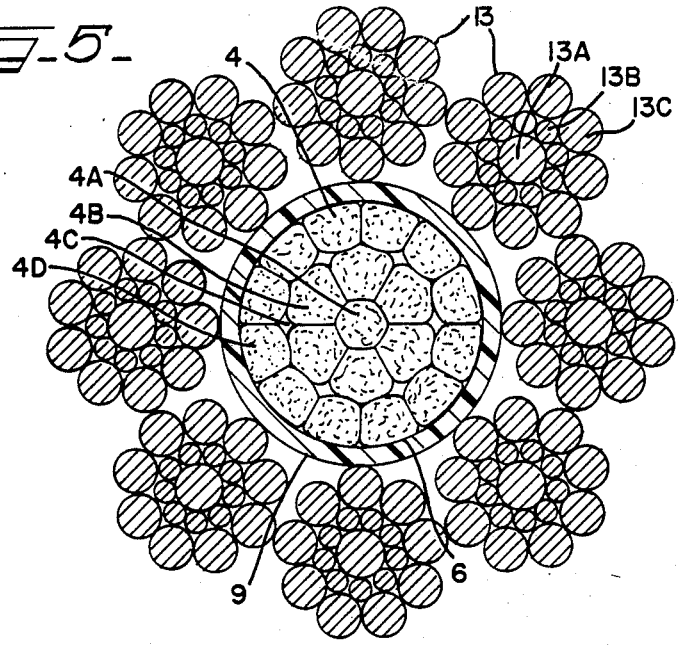
FIG. 5 is a cross-sectional view of a finished rope according to a preferred embodiment of the present invention.

As seen in FIG. 4, a finished rope is then produced. A number of steel outer strands 13 are closed in a helical fashion in a closing machine 14 by forming said strands over the coated multi-element core 6 in a closing die 15. The rope passes through postforming rollers 16 which impart radial pressure to bed the strands into the plastic cover. Subsequently, the rope passes through an equalization system 17 which facilitates removal of constructional stretch, after which the finished rope 18 is wound onto reels 19 for shipment. The finished rope so produced is shown in FIG. 5.

Coating 9 applied to core 6 can be of several embodiments, the most common of which is a thermoplastic. It is also possible for coating 9 to be comprised of an elastomer. Further, it is possible to wrap, rather than extrude coating 9 on core 6; in such case coating 9 would be a paper, woven fabric, or a plastic film.

Outer strands 13 are most typically of a wire rope configuration and are usually comprised of individual metal wires. The preferred metal for such wires is steel. Such metal wires include center wire 13A which is surrounded by inner wires 13B. Outer wires 13C surround inner wires 13B. As mentioned above, such strands 13 are formed in a helically twisted lay such that inner wires 13B and outer wires 13C are twisted about center wire 13A. Further, all outer strands 13 are helically twisted about coated core 6.

Figure 6:
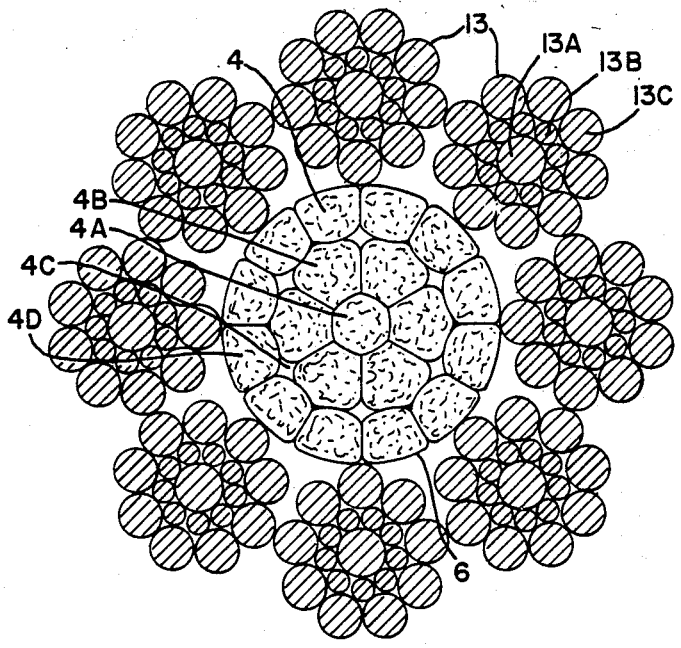
FIG. 6 is a cross-sectional view of a finished rope according to another embodiment of the present invention.

Referring now to FIG. 6, an embodiment of a wire rope in accordance with the present invention is shown. This embodiment is identical to that shown in FIG. 5, so that similar numerals are used, with the exception that no coating 9 is applied to cover core 6.

Figure 7:
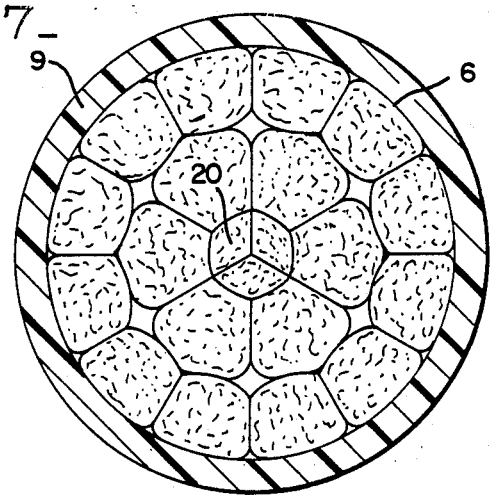
FIG. 7 is a cross-sectional view showing an alternative embodiment of a core member.

In another embodiment of the rope core 6 seen in FIG. 7, a material 20 with lower elastic modulus, such as a polyolefin, polyester, or nylon, fabricated as twisted monofilaments, is substituted for the high strength synthetic material in the center element shown as 4A in FIG. 5. Efficiency of the core member is enhanced through improved load sharing of elements, although overall tensile strength is reduced compared to the preferred embodiment. The core member is fabricated by substituting the correct size low modulus material in the core stranding operation described in FIG. 2. Subsequent processing of the core member to provide a protective covering, and the laying of the steel outer strands to produce the finished rope, follow the steps of the previously described embodiments.

Figure 8:
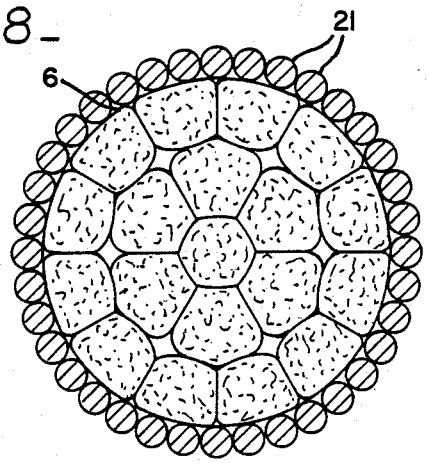
FIG. 8 is a cross-sectional view of an alternative embodiment of a core member with an armor wire covering applied over the core member.
Figure 9:
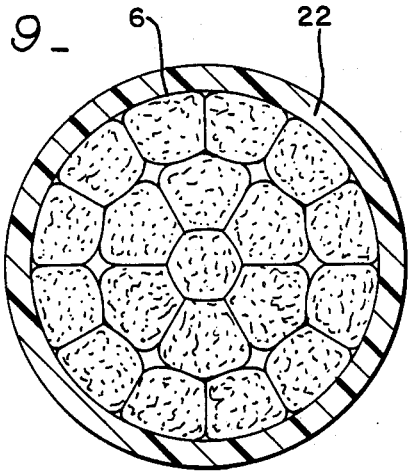
FIG. 9 is a cross-sectional view of an alternative embodiment of a core member with a braided outer covering.

In another embodiment of the rope core 6 shown in FIGS. 8 and 9, alternate methods are used to provide a protective covering to the core member 6. In FIG. 8, the core member 6 has been covered by a process known to the industry as armoring whereby a layer of metal wires 21 is helically laid over the core member 6 using conventional stranding equipment. In FIG. 9, the core member 6 has been covered using a process known to the industry as braiding or plaiting, which provides a continuous nonrotating covering 22. The elements used in such a process can consist of a variety of materials, including natural or synthetic fibers as well as metallic wires, which are interwoven using specialized equipment.

A detailed description of a wire rope embodying the present invention will now be provided with reference to FIG. 5. A ½ inch (12 mm) diameter wire rope of 8×19 construction (eight outer strands 13 each comprising nineteen wires), and a core 6 of 1×25F (one core member comprising nineteen elements 4A, B, D and six filler elements 4C) is provided. A multitude of 1500 denier yarns produced from synthetic fibers of Kevlar aramid type 960 material are drawn and downtwisted in a left lay direction. The twist rates are selected according to the following formula:

$$TPI = ((1.1\ T.M.) \times (73))/\sqrt{DENIER}$$

Dependent on desired element diameter, generated by varying the number of yarns incorporated in same, each element is manufactured to provide a maximized strength, achieved using the recommended 1.1 twist multiplier. The net effect in usage of the 1.1 value is the fabrication of elements with varying degrees of twist levels dependent on diameter presented below:

1 × 25F Kevlar Synthetic Core Elements

| Wire Position (Gallery) | Diameter in. (mm) | Denier | Twist Level (TPI) | Helix Angle (Degrees) |
|---|---|---|---|---|
| Outer | 0.0722 (1.8) | 21394 | 0.49 | 6.34 |
| Filler | 0.0284 (0.72) | 3302 | 1.12 | 5.76 |
| Inner | 0.0749 (1.9) | 23037 | 0.46 | 6.18 |
| Heart | 0.0801 (2.0) | 26325 | 0.44 | 6.32 |

Total Denier = 441087

It should be noted that the lay angle for the filaments is variable, ranging downward from a maximum value when each filament is positioned on the outside surface of both the element and the gallery within the core itself (at which point the component lay angles introduced in winding and stranding reinforce one another).

Various other core configurations are within the scope of the present invention. These configurations are shown in FIGS. 10–15. All such cores are comprised of aramid fiber elements of various diameters.

Figure 10:
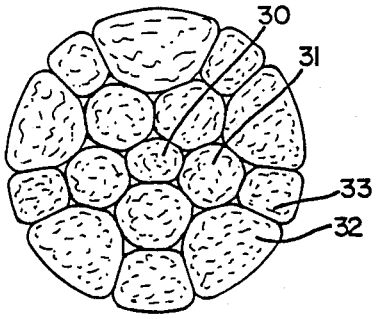
FIG. 10 is a cross-sectional view of an alternative embodiment of a core member.

In FIG. 10, center element 30 is surrounded by five larger diameter inner elements 31. The outer core layer includes five larger diameter elements 32 alternated with five smaller diameter elements 33.

Figure 11:
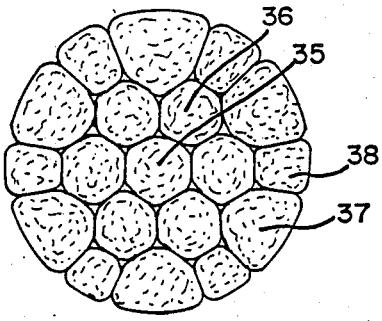
FIG. 11 is a cross-sectional view of an alternative embodiment of a core member.

In FIG. 11, center element 35 is surrounded by six similar diameter inner elements 36. The outer core layer includes six larger diameter elements 37 alternated with six smaller diameter elements 38.

Figure 12:
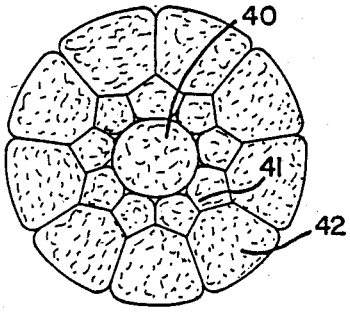
FIG. 12 is a cross-sectional view of an alternative embodiment of a core member.

In FIG. 12, center element 40 is surrounded by nine smaller diameter inner elements 41. The outer core layer includes nine larger diameter elements 42.

Figure 13:
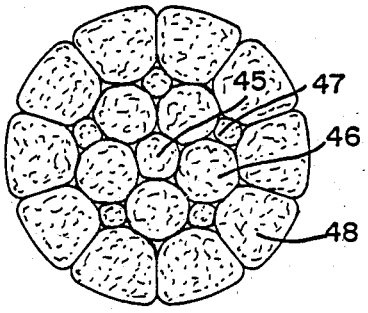
FIG. 13 is a cross-sectional view of an alternative embodiment of a core member.

In FIG. 13, center element 45 is surrounded by five larger diameter inner elements 46 and five small diameter filler elements 47 in the outer gaps of inner elements 46. The outer core layer includes ten larger diameter elements 48.

Figure 14:
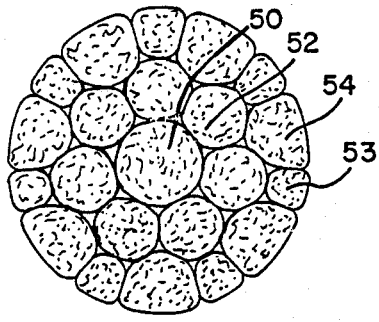
FIG. 14 is a cross-sectional view of an alternative embodiment of a core member.

In FIG. 14, center element 50 is surrounded by seven inner elements 52. The outer core layer includes seven smaller diameter elements 53 alternated with seven larger diameter elements 54.

Figure 15:
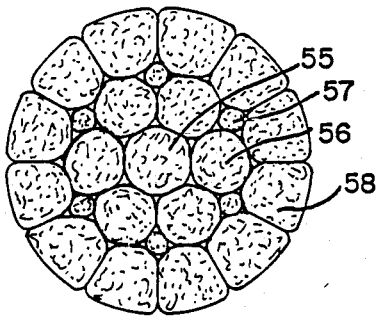
FIG. 15 is a cross-sectional view of an alternative embodiment of a core member.

In FIG. 15, center element 55 is surrounded by six inner elements 56, with six filler elements 57 in the outer gaps of inner elements 56. The outer core layer includes twelve elements 58.

It should be understood that all the core configurations shown in FIGS. 10–15, when formed into a finished rope, might have a jacket or coating similar to coating 9 of FIG. 5. Further, the core would be surrounded by outer strands similar to outer strands 13 of FIG. 5.

The core produced in accordance with the preferred embodiment has been examined in an effort to develop a Young's Modulus value. In this study, theoretical relationships for modulus derivation were found lacking, due to several variables including:

(1) Variation of lay angle within any element within one strand lay;

(2) Variation of lay angles between each element gallery within the core;

(3) Effects of inter-member and inter-filament friction due to the use of a unit or equal lay design; and (4) Effects of constriction and resulting radial compression forces imparted to the core by the steel outer strands.

As a result, elastic modulus determinations were conducted on completed core samples, using the standard formula for determination of Young's Modulus, which is: Modulus=(unit load/cross sectional area)/unit strain Based on elongation tests, these values average 8,300,000 PSI (585,000 kg/cm$^2$) based on expected operating stress ranges encountered in a service application. Referring to the AISI Wire Rope Users Guide, the rated modulus for a standard 8×19G fiber core construction at the design factors listed for elevator applications is listed as 8,100,000 PSI (571,000 kg/cm$^2$) comparing very favorably with our core test data values.

The rope produced per the preferred embodiment, being a nominal ½" diameter in an eight-strand Tractiongrade Seale construction (8×19G), developed an average ultimate tensile strength (UTS) of 32,900 lbs. (14,500 kg) as compared to a value of 18,900 lbs. (8,600 kg) for the standard sisal core rope.

As evidenced above, the rope per the preferred embodiment exhibits a strength character far in excess of nominal strength requirement of 14,500 lbs. (6,600 kg) for this diameter and grade, by an average of 125%. This average is also 72% over the current production average for sisal-cored rope. This is achieved with little or no difference in unit weight.

The rope produced in accordance with the preferred embodiment has been compared to the standard sisal rope using stress-strain relationships developed in testing to develop actual elastic moduli.

In the load ranges specified by design factors of 7.6 to 11.9, the effective load would be 13.2% to 8.4% of the nominal tensile strength of the rope. In this range of loading, the rope of the present invention enjoys a modest advantage over the standard sisal material. This indicates that the helix angle introduced into the core member has effectively served to balance the modulus of the rope, with equal load sharing developed between core and steel outer strands, over the load range seen in service applications. The elongation character of the standard rope as compared to the rope of the present invention (based on elastic stretch after sample conditioning by three cycles of loading from 2–40% of the nominal breaking strength of the rope) is listed in the table below. Elongation in inch/inch relative to applied load and ultimate tensile strength (% UTS) is presented as follows:

| Percent Elastic Elongation (in./in.) | Enhanced Core | | | Sisal Core | | |
|---|---|---|---|---|---|---|
| | Load-lb. | (kg) | % UTS | Load-lb. | (kg) | % UTS |
| 0.12 | 949 | (430) | 2.92 | | | |
| 0.16 | 1401 | (636) | 4.30 | | | |
| 0.20 | 1853 | (842) | 5.69 | | | |
| 0.24 | 2372 | (1078) | 7.28 | 1052 | (478) | 5.58 |
| 0.28 | 2924 | (1330) | 8.98 | 1499 | (681) | 7.94 |
| 0.32 | 3531 | (1605) | 10.84 | 1952 | (887) | 10.33 |
| 0.36 | 4160 | (1890) | 12.77 | 2501 | (1137) | 13.24 |

-continued

| Percent Elastic Elongation (in./in.) | Enhanced Core | | | Sisal Core | | |
|---|---|---|---|---|---|---|
| | Load-lb. | (kg) | % UTS | Load-lb. | (kg) | % UTS |
| 0.40 | 4832 | (2196) | 14.83 | 3110 | (1414) | 16.46 |

As a function of load, the rope of the present invention provides measurable enhancement over the standard rope in terms of unit elastic stretch when related to load in pounds. When treated as a function of tensile strength, the elastic stretch values obtained compare favorably with those expected for larger diameter standard sisal-cored ropes.

Constructional stretch present from manufacturing operations was also shown to be less significant for the enhanced product, with values of 0.35% established for the standard sisal core rope, versus 0.15% measured for the rope of the present invention, a factor of 2.5 times less.

What is claimed is:

1. A rope comprising a core comprising a plurality of helically twisted elements, each element comprising a plurality of helically twisted high strength synthetic yarns, and outer strands arranged in a helical pattern surrounding said core, each of said outer strands comprising a plurality of helically twisted metal wires, with the rope achieving a balanced set of helices whereby the elastic modulus of the core and the elastic modulus of the outer strands are about equal.

2. The rope of claim 1 wherein said synthetic yarns in said core are comprised of polyamide, polyolefin, carbon or boron fibers.

3. The rope of claim 1 further comprising a layer of strands surrounding said core.

4. The rope of claim 1 further comprising a layer of coating material on said core.

5. The rope of claim 4 wherein said layer of coating material is comprised of a thermoforming, thermosetting or elastomeric plastic, paper, woven fabric or plastic film.

6. The rope of claim 1 wherein the core elements are lubricated.

7. The rope of claim 1 wherein the core elements are bonded with a resin or similar bonding compound.

8. A rope comprising a core comprised of a plurality of core elements wound in a helical configuration, each of said core elements comprised of a plurality of high strength synthetic yarns, and a plurality of outer strands arranged in a helical configuration around said core, each of said outer strands formed by a plurality of metal wires arranged in a helical configuration, with the rope achieving a balanced set of helices whereby the elastic modulus of the core and elastic modulus of the outer strands are about equal.

9. The rope of claim 8 wherein said core synthetic yarns are comprised of polyamide, polyolefin, carbon or boron fibers.

10. The rope of claim 8 wherein said synthetic yarns are arranged in a helical configuration to form said core elements.

11. The rope of claim 8 further comprising a jacket surrounding said core.

12. The rope of claim 11 wherein said jacket comprises metal wires, natural fibers or synthetic fibers.

13. The rope of claim 8 further comprising a layer of coating material on said core.

14. The rope of claim 13 wherein said coating material is comprised of a thermoforming, thermosetting or elastomeric plastic, paper, woven fabric or plastic film.

15. The rope of claim 8 wherein said core elements are lubricated.

16. The rope of claim 8 wherein said core elements are bonded with a resin or similar bonding compound.

17. A method of producing a rope comprising the steps of twisting high strength synthetic yarns into core elements, helically winding such core elements to form a rope core, and helically laying a plurality of outer strands about said core, each of said outer strands comprising a plurality of metal wires, wherein the elastic modulus of the core and the elastic modulus of the outer strands are about equal.

18. The method of claim 17 wherein said high strength synthetic yarns are comprised of polyamide, polyolefin, carbon or boron fibers.

19. The method of claim 17 wherein a lubricant is applied to the core elements as they are wound to form said rope core.

20. The method of claim 17 wherein a coating material is applied to said rope core.

* * * * *